US005752619A

United States Patent [19]

Fulton

[11] Patent Number: 5,752,619

[45] **Date of Patent: *May 19, 1998**

[54] PAINT CAN ATTACHMENT

[76] Inventor: James Henry Fulton, 4000 Flynn St. #58, Bellingham, Wash. 98226

[ * ] Notice: The terminal 18 months of this patent has been disclaimed.

[21] Appl. No.: 124,991

[22] Filed: Sep. 13, 1993

Related U.S. Application Data

[63] Continuation-in-part of Ser. No. 619,091, Nov. 28, 1990, abandoned.

[51] Int. Cl.[6] ..... B65D 25/34

[52] U.S. Cl. ..... 220/701; 220/733; 220/736

[58] Field of Search ..... 220/695, 697, 220/700, 701, 733, 736, 354

[56] References Cited

U.S. PATENT DOCUMENTS 3,945,527 3/1976 Pylant ..... 220/733 X 4,116,332 9/1978 Hartley ..... 220/697

*Primary Examiner*—Stephen J. Castellano

[57] ABSTRACT

The invention relates to an attachment piece designed to fit onto the top of conventional paint cans in order to provide a seal to stop paint from dripping onto the rim of the can, to provide two scrapers so that the excess paint on the brush can be scraped off and returned to the can, this scraping action also sharpens the paint brush edge allowing for more precise application of the paint, the device also provides a convenient rest for the paint brush. The attachment piece comprises of a round plastic lid with the center cut out to create the scrapers and rests. The outer edge of the lid has a lip encompassing it's entire circumference. The purpose of the lip is to secure the attachment to the paint can. In addition, there is a wedge shaped seal running the full circumference of the device that, when attached to the can, will fit into the grove of the paint can and act as a further seal to prevent paint from entering the rim of the paint can. The attachment is held firmly in place by the holding action of the lip on the attachment's outer edge.

2 Claims, 1 Drawing Sheet

PAINT CAN ATTACHMENT

This application is a continuation-in-part of application No. 07/619/091 filed on Nov. 28, 1990, now abandoned.

BACKGROUND OF THE INVENTION

1. Field of the Invention

The invention is related to the field of paint can accessories. In particular to those accessories designed to reduce or eliminate unwanted paint on the rim of paint cans. The invention that is the subject of the present application is an attachment piece that will fit onto existing paint can tops to eliminate this problem.

2. Description of the Prior Art

There presently is no attachment available that will accomplish the tasks of the apparatus described herein. No device has been marketed that provides the combination of a sealer, scraper, and brush rest with such relative simplicity. The device is designed to be placed on the paint can at the factory and will be made a complimentary item. It will be made in all sizes.

The only device presently marketed to reduce the unwanted paint from the can lid is really just a funnel you insert into the can. It provides no sealing action, scraping or bush rest capability. There are a few other devices that attach, to paint cans but are not intended to accomplish the actions of the apparutus described herein.

SUMMARY OF THE INVENTION

The attachment piece of the present invention is used to prevent the accumulation of unwanted paint on the rim of a paint can. The device is designed to fit snugly onto the top of the paint can through the holding action of the lip on the device. The device consists of a circular piece of plastic, it has the center cut out in such a way that it creates two scraping surfaces, and two brush rests. In addition, as part of the construction, there is a wedge shaped seal on the underside of the device that will fit into the grove of the paint can rim and when pressed down will further restrain the paint from entering the rim of the can.

It is the object of this invention to provide an attachment piece for conventional paint cans that will prevent the accumulation of unwanted paint on the rim of the can.

Another objective of the invention is to provide convenient double scrapers so that excess paint can be removed from the brush, this scraping action also acts to sharpen the edge of the brush making application of the paint much more precise. The double scraping edge eliminates the necessity of turning the brush to scrape the opposite side. Elimination of the necessity of turning the brush greatly reduces wrist fatigue and significantly simplifies the painting operation.

Another objective of the invention is to provide a convenient rest for the brush. The bush rests are designed into the apparatus described herein as described in the attached drawing.

Another objective of the invention is to provide adequate sealing action so that paint may be poured from the can into other receptacles. The combined holding action of the lip on the apparatus described herein and the wedge seal that is pressed into the recessed rim of the paint can will provide the necessary sealing power to allow for the pouring action.

In addition to the obvious application of the device another objective of the invention is to provide an accessory that costs so little, that it may be given as a complimentary item by the paint companies.

Another objective of the device is to save paint by reducing waste. This is accomplished by two actions. The brush scraping action will return excess paint directly to the paint can, and the sealing action of the apparatus will prevent unwanted paint from entering the paint can rim.

Another objection of the device is to provide advertising space on the brush rest areas. The device can be made in the various corporate colors and "logos" and advertising statements may be added thereto.

Other objectives will become known to those skilled in the art once the invention is shown and described.

DESCRIPTION OF THE PREFERRED EMBODIMENT

Figure 1:
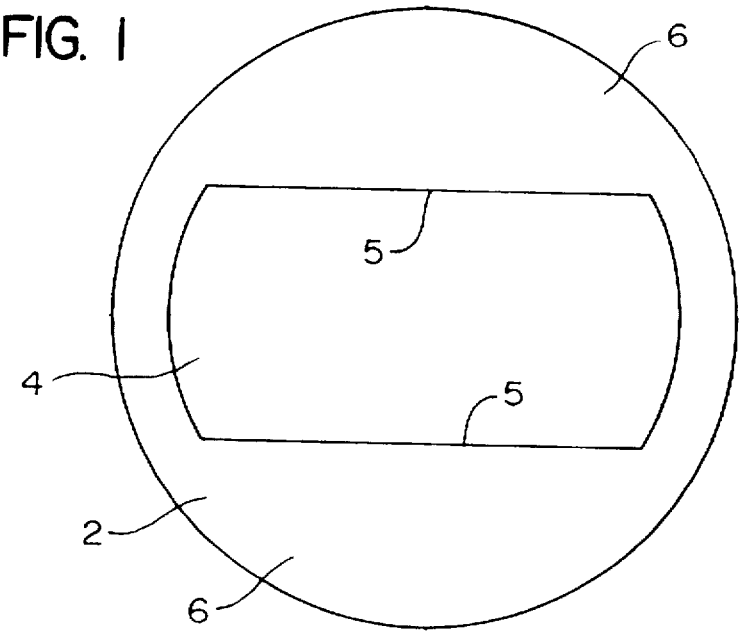
FIG. 1 shows the outline of the apparatus. The center part of the device is cut away and at once forms the rest and scrapers.
Figure 2:
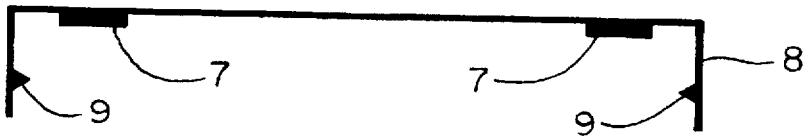
FIG. 2 shows a cross section of the apparatus.

The invention is an attachment apparatus 2 (See FIG. 1) for conventional paint cans so that paint is restricted from entering the rim of the paint can, to provide scraping action for the brush, a rest for the brush and capability of pouring paint from the can without having excess, unwanted paint entering the rim of the paint can.

The invention comprises a round piece of plastic consisting of a scraper 5, sealing wedge 9, and brush rest 6. As described in FIGS. 1 through 5.

FIG. 5 is a description of the apparatus in a slightly different configuration. This application is changed only to the extent that the sealing wedge is eliminated. This application will be used on smaller paint cans that are not generally used to pour paint into other receptacles (ie: quart and smaller sized cans)

The projecting piece 7 projects downward from a point near the outer edge of the device 2 and should be about 3.5 mm. in height. That is the distance from the top of the apparatus to the bottom of the projecting portion. This distance is relatively small and allows the projecting piece to be inserted into the channel of the paint can that is close to the rim of the can. It is preferred that this portion have squared sides as shown. This projecting portion runs continuously and, in close connection near the entire circumference of the circular shaped attachment piece.

The use of the extended portion allows the channel found near the periphery of paint cans to be gripped by this portion to thereby prevent paint from filling in this groove which would otherwise make securing the lid to the paint can difficult.

Figure 3:
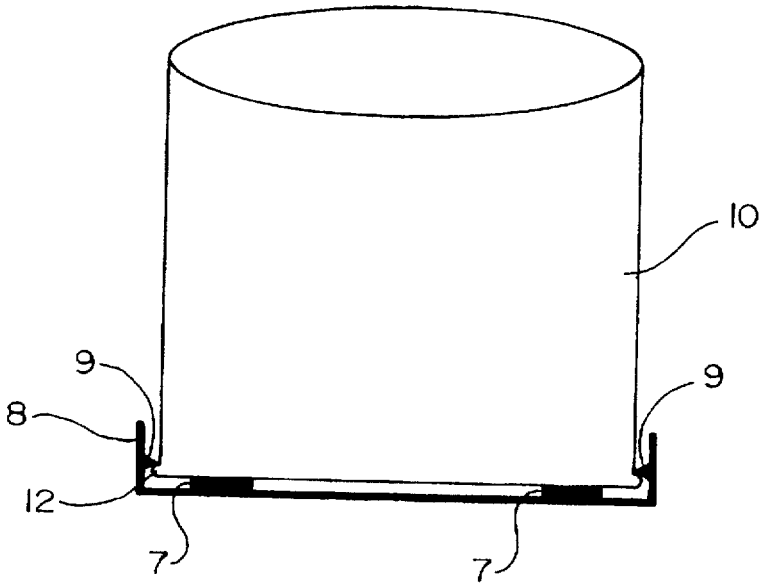
FIG. 3 Shows a cross section of the apparatus in use attached to a paint can.

It is preferred that the device be attached to the bottom of paint cans prior to filling the can with paint during the manufacturing process. This configuration is shown in FIG. 3. Storing the device on the bottom of the can also protects the can from rusting and possibly damaging other surfaces.

In addition to the projecting portion at 7 a second securing means is used at each peripheral edge of the apparatus. This securing means has a downwardly extending portion 8 with an extended wedge shaped portion 9. This wedge interlocks just below the bead 12 of the paint can that is on the upper edge of the can. Of course, when the scraper is on the bottom of the can the wedge would be above the bead. This wedge allows the device to grip the sides of the paint can and help the device to stay on.

Once the device is attached to the paint can. It will be possible to perform a number of tasks simultaneously. The individual can dip the brush through the center central aperture 4 into the paint, he then can draw the paint brush against the sides 5 of the stripping edges, without having to turn the brush, and eliminate the excess paint from the brush, this action also has the effect of sharpening the edge of the brush providing a more precise application of the paint. Should the painting job be interrupted, the brush may be laid to rest on the built in rest positions. If necessary the paint can be poured into other receptacles.

Conventional material used in construction will probably be some form of plastic, however biodegradable material should not be overlooked.

I claim:

1. A paint scraper apparatus for attachment to paint cans that have annular beads near the top and bottom edges of said paint cans and a channel running in close connection with said bead, said apparatus comprising: a circular shaped portion having a centrally located opening, said circular shaped portion having a circular shaped peripheral edge and having an annular lip in connection with said peripheral edge said annular lip in perpendicular relation to said circular shaped portion, an extended portion near said peripheral edge and running in continuous fashion near said peripheral edge, said extended portion of shape and size adapted to fit said channel, said lip having at least one indented portion fixed in perpendicular relation to said lip, said wedge-shaped portion for interlocking with said annular beads to thereby secure said apparatus to said can.

2. The apparatus of claim 1 wherein said extended portion is about 3.5 millimeters in height.

* * * * *